US007089845B2

(12) United States Patent
Friedli et al.

(10) Patent No.: US 7,089,845 B2
(45) Date of Patent: Aug. 15, 2006

(54) METHOD AND DEVICE FOR AIMING A WEAPON BARREL AND USE OF THE DEVICE

(75) Inventors: Andreas Friedli, Marthalen (CH); Markus Oberholzer, Frauenfeld (CH); Marc Bertholet, Zürich (CH); Aw Cheng Hok, Singapore (SG); Ng Say Him, Singapore (SG)

(73) Assignees: Chartered Ammunition Industries Pte Ltd., Singapore (SG); Oerlikon Contraves AG, Zurich (CH)

( * ) Notice: Subject to any disclaimer, the term of this patent is extended or adjusted under 35 U.S.C. 154(b) by 0 days.

(21) Appl. No.: 10/267,268

(22) Filed: Oct. 9, 2002

(65) Prior Publication Data

US 2003/0145719 A1 Aug. 7, 2003

(30) Foreign Application Priority Data

Oct. 12, 2001 (CH) ..... 1880/01

(51) Int. Cl.
*F41G 5/06* (2006.01)

(52) U.S. Cl. ..... 89/41.05; 89/41.17; 89/41.19; 42/115

(58) Field of Classification Search ..... 89/41.05, 89/41.01, 41.17, 41.19; 42/114, 115
See application file for complete search history.

(56) References Cited

U.S. PATENT DOCUMENTS 4,878,752 A * 11/1989 Bramley ..... 356/152.2
4,965,439 A * 10/1990 Moore ..... 235/404
5,375,072 A * 12/1994 Cohen ..... 702/94
5,686,690 A 11/1997 Lougheed et al.
5,822,713 A 10/1998 Profeta
5,824,942 A 10/1998 Mladjan et al.
6,247,259 B1 * 6/2001 Tsadka et al. ..... 42/114
6,252,706 B1 6/2001 Kaladgew
6,269,730 B1 * 8/2001 Hawkes et al. ..... 89/41.05
6,397,509 B1 * 6/2002 Langner ..... 42/116

FOREIGN PATENT DOCUMENTS

CA 2245406 2/2000

(Continued)

*Primary Examiner*—M. Clement
(74) *Attorney, Agent, or Firm*—McCormick, Paulding & Huber LLP

(57) ABSTRACT

A method for aiming a weapon barrel [B], wherein a target image [Z*] and a target marker [X] are displayed with the aid of an image visualization unit M. The rough aiming of the weapon barrel [B] is performed in a first phase, in a second phase, with the weapon barrel [B] stationary, sighting by sighting the target image [Z*] by means of the image visualization unit [V] is performed, wherein the target image [Z*] and the target marker [X] are brought into coincidence as closely as possible, and fine aiming of the weapon barrel [B] in a third phase. The device for executing the method comprises a device for setting an initial gun sight angle [$\psi_o$] an image visualization unit [V], the latter displays a target image [Z*] and a target marker [X] representing the end of an imaginary projectile trajectory [p]. The device contains a fire control device, with the image visualization unit [V], an angle measuring device [Y] for measuring angular changes [$\Delta\psi$] and a data processing unit [EDV] for performing a ballistics calculation, in which the angular change [$\Delta\psi$] and the interior ballistics can be taken into consideration, as well as for issuing a signal determining the target marker [X]. The device is suitable for infantry weapons.

11 Claims, 3 Drawing Sheets

FOREIGN PATENT DOCUMENTS

| | | |
|---|---|---|
| FR | 2 722 280 | 1/1996 |
| FR | 2 760 831 | 9/1998 |
| FR | 2 788 845 | 7/2000 |
| WO | WO 96/01404 | 1/1996 |

* cited by examiner

METHOD AND DEVICE FOR AIMING A WEAPON BARREL AND USE OF THE DEVICE

CROSS REFERENCE TO RELATED APPLICATION

Applicant hereby claims foreign priority under 35 U.S.C. § 119 from Swiss Patent Application No. 2001 1880/01, filed 12 Oct. 2001, the disclosure of which is herein incorporated by reference.

FIELD OF THE INVENTION

The invention relates to a method for aiming a weapon, having a weapon barrel with a weapon barrel axis, on a target, wherein a target image representing the target, and a target marker representing the end of a projectile trajectory, are displayed with the aid of an image visualization unit. The invention further relates to a device for executing the method, as well as to the use of the device.

BACKGROUND OF THE INVENTION

When firing infantry weapons, such as rifles, assault rifles, grenade launchers and mortars, aiming of the weapon barrels is performed manually in most cases by aiming at the target without the aid of a fire control device.

Prior to firing it is necessary to set a gun sight angle at the weapon, which is a function of the deployment distance by which the target is distant from the weapon. In connection with direct firing, that angle by which the weapon must be aimed higher than the aiming line is called the gun sight angle. In direct firing the projectiles fired from the weapon barrel move on a projectile trajectory which coincides with the aiming line at the mouth of the weapon barrel, then lies above the aiming line and then should again coincide with the aiming line at the target. Therefore the exact setting of the gun sight angle is imperative for making hits, and the deployment distance must be exactly known for determining the gun sight angle.

In connection with direct firing, for which light infantry weapons are primarily employed, aiming for the target is made by the naked eye. The deployment distance, i.e. the distance to the target, is determined without any aids. However, it is almost impossible to exactly determine the deployment distance by the naked eye, therefore a distance range, within which the exact deployment distance is presumed to lie, is generally estimated. In certain cases, namely if the topographic position of the target is known, the deployment distance can be exactly determined by means external to the weapon, for example with the aid of a topographic map. It is also possible to measure the deployment distance to a visible target with the aid of a distance measuring unit, for example a laser distance measuring unit.

Medium and heavy infantry weapons in particular are also used for indirect firing, i.e. for hitting targets which are separated from the weapon by an impermeable obstacle and are not visible. In this case the deployment distance cannot be measured. It must either be estimated without a visual aid on the basis of a possible, or presumed position of the target, or it must be determined with the aid of means external to the weapon.

In direct firing, aiming for the target can take place by the naked eye with the aid of a simple aiming device, for example a conventional rear/front sight aiming device, without any optical device.

But rear/front sight aiming devices have two large disadvantages, which result in the inability to precisely aim the weapon barrel: for one, the deployment distance is only approximately known in most cases, since it must be estimated by the naked eye; furthermore, there is only a vague image of the target because of the lack of an optical enlargement, and the weapon can therefore not be stably aimed.

Infantry weapons can also have optical aiming devices as aids in aiming for the target. Such aids which, within the scope of the present specification will be generally called image visualization units, can have telescopic sights, for example. In this case the rifleman can see an enlarged image of the target, or a target image, as well as markings engraved in the image visualization unit, or a target mark. The determination of the deployment distance takes place either as described above by the naked eye, or with the aid of a laser distance measuring unit. The telescopic sight is mounted in such a way that its optical axis is aimed parallel with the weapon barrel axis, and the possibly also provided laser distance measuring unit is aimed parallel with the weapon barrel axis. If no gun sight angle were to be taken into consideration, this would lead to corresponding inaccuracies. This problem becomes more serious in connection with slow-flying projectiles, such as grenades, since the long flying time of such projectiles demands a comparatively large gun sight angle.

Essentially, the disadvantages of the image visualization unit in the form of a telescopic sight are the following: The orientation of the telescopic sight parallel with the weapon barrel limits the selection of the enlargement; a gun sight angle, which must be set at the weapon, determines the deviation between the aiming line and the weapon barrel axis, by means of which a target marker is displayed; if the deployment distance is too great, these gun sight angles are relatively large, which has the result that the target marker can no longer be displayed in an optical device capable of considerable enlargement. Moreover, distortions are received in case of too large a deviation, unless an optical device is employed which is absolutely free of distortion and therefore expensive.

In summary it can be stated that up to now no devices which permit exact sighting of the target and aiming of the weapon barrel are known for infantry weapons. This was not considered to be a great lack, as long as the projectiles fired from infantry weapons were equipped with contact fuses to a large extent. But it is preferred to also fire projectiles with programmable ignition, which detonate prior to impact, from infantry weapons; such projectiles are also called ABM [Air Burst Munitions]. ABM have numerous advantages over conventional munitions: the ABM projectiles penetrate concealing bushes or thin woods, as well as masses of snow of considerable thickness, without detonating prematurely; ABM are excellently suited for house-to-house fighting, since window panes and thin walls are penetrated and the effect of the projectile is directed forward; the feared ricochet effect, which otherwise often occurs with conventional munitions and extended projectile trajectories, cannot occur. However, the use of ABM can only be successful if it is possible to accurately determine the projectile trajectories, or when the weapons used have devices which permit the exact sighting of the target and aiming of the weapon barrel.

Weapons systems with fire control devices which permit swift aiming, some even on rapidly moving targets, are known in the fields of artillery and anti-aircraft artillery. However, the technology of these very elaborate weapons systems cannot be transferred to infantry weapons, which should be simple in construction and handling, cost-effective, light and mobile to the highest degree, and must operate autonomously.

OBJECT AND SUMMARY OF THE INVENTION

It is therefore the object of the invention to propose an improved method of the type mentioned at the outset, which avoids the disadvantages of the prior art;

to produce a device of the type mentioned at the outset for executing the method; and to show a use for the device.

The novel method contains several phases: rough aiming of the weapon barrel takes place in a first phase. To this end, infantry-like method steps, or those performed by the rifleman, are performed, for which no special aids, and in particular no data processing unit, is used. The actual aiming takes place in a second phase, in which only the image visualization unit is moved and by means of it a target image is sighted. To this end process steps are performed inter alia, which up to now had only been taken in connection with methods employed by artillery or anti-aircraft artillery, or with the aid of a fire control device, i.e. method steps for which an image visualization unit, as well as a fire control device with a data processing unit are required; however, the fire control device used in this case cannot be compared to fire control devices such as are used for anti-aircraft guns; it is considerably more simple and in general is arranged internally in the weapon, so that no connecting devices external to the weapon are required, and the weapon remains autonomous; in comparison with fully automated fire control devices for anti-aircraft guns, the fire control device used here can be called partially automated. Fine aiming takes place in the third phase, again in the conventional manner, i.e. by the rifleman and without the aid of the data computed by the fire control device.

When executing the method, there are differences between direct firing and indirect firing.

With direct firing, the target is roughly sighted and the weapon barrel roughly aimed in the first phase, i.e. the azimuth and elevation of the weapon barrel are approximately fixed. Thereafter the azimuth only changes if the weapon is not placed horizontally, since in that case a change in elevation results in a correlated change of the azimuth. The elevation is determined on the basis of deployment data which describe the relative position of the target in respect to the weapon, including the topographic profile between target and weapon. During direct firing, the relevant deployment data only contain the deployment distance, or a deployment distance range; these must be at least approximately determined. An initial gun sight angle, i.e. the angle between the weapon barrel axis and the aiming line, or the optical axis of the image visualization unit, is set as a function of the previously determined deployment distance, or the previously determined deployment distance range. After setting the initial gun sight angle, the weapon barrel axis and the aiming line, or the optical axis of the image visualization unit, are arranged in such a way that they include an initial gun sight angle. Therefore the optical axis of the image visualization unit lies not parallel with the weapon barrel, such as in conventional sighting device, but is adapted to the at least approximately determined deployment distance. By means of this it is achieved that in the further attack on the target, or during continued aiming at the target, only the distortion-free central area of the optical image visualization unit is always used.

With direct firing, aiming taking place in the second phase can be called real aiming. As already mentioned, the weapon barrel remains in its position set in the first phase during aiming. The target image is a real image of the target and is more exactly sighted, or followed, by means of the optical image visualization unit, i.e. the position of the image visualization unit changes in respect to the weapon barrel axis, as well as absolutely. The gun sight angle changes because of this, i.e. the initially set gun sight angle becomes larger or smaller by an angular change. This angular change is continuously measured, so that the length of the aiming line in relation to the position of the weapon barrel is always known. The deployment distance is generally newly and, if possible, more accurately determined than in the first phase of the method. As already mentioned, the fire control device with the data processing unit is used in the second phase. The data processing unit conducts a ballistics calculation—similar to a data processing unit for artillery or anti-aircraft guns—, taking into consideration the deployment distance, the gun sight angle, or the lateral chronological change of the gun sight angle, as well as data which define the interior ballistics of the projectiles to be fired. To this end, at least the following data are made available to the data processing unit: the deployment distance, the gun sight angle, or the chronological angular change of the gun sight angle; the data, which define the interior ballistics of the projectiles to be fired. The data processing unit makes available a signal, based on its ballistics calculation, which is used by the image visualization unit. The image visualization unit is designed in such a way that a target marker can be faded in, whose position is determined by the signal from the data processing unit. The visible result of the ballistics calculation consists in that the target marker, which represents the end of an imaginary projectile trajectory, or an aiming line, and a target image which, in this case, is actually an image of the target, can be recognized in the view of the rifleman. The deviation of the target marker from the target image is a measure of a residual gun sight angle, or an angular change by which the actual gun sight angle must be changed so that the projectile will hit the target to be attacked.

If no target marker is visible at the start of the second phase, this means that the rough aiming in the first phase was not performed with sufficient accuracy, which also includes the possibility that movement of the target took place at a speed which can only just, or not at all, be handled by the weapon used, or by the device used for aiming. Anyway, the method must again be started with the first phase in such a case.

Aiming the weapon barrel is terminated with the third phase, in which fine aiming takes place. In the course of fine aiming the target marker and the target image are brought into congruence as accurately as possible.

With indirect firing, the target is not visible, but is arranged behind an obstacle. The aimed at target image is not an image of the target, but an auxiliary image, which can be faded in and whose position is determined by the deployment data. The deployment data, which describe the position of the target relative to the weapon, including the topographic profile between the weapon and the target, here comprise the deployment distance, the deployment height between the weapon and the target, the relevant obstacle distance between the weapon and the obstacle, and the relevant obstacle height between the weapon and the obstacle. The deployment data are already exactly determined in the first phase. Means external to the weapon are employed for determining the deployment data. The deployment data can be found in a topographic map. The position of the target can also be possibly determined or estimated on the basis of weapons effects emanating from the target to be attacked, or it can be assumed, taking into consideration general tactical basics which the enemy presumably obeys. The initial gun sight angle is set in accordance with the mentioned deployment data.

With indirect firing it is generally not necessary or possible to determine the deployment data more accurately in the second phase, since they are either already exactly known, or cannot be determined more accurately. Aiming, which here can be called spurious aiming, also takes place with indirect firing, in that the target image, or an imaginary target, is aimed at by means of the image visualization unit. In the course of this, the initial gun sight angle is displaced by an angular change. The following data are made available to the data processing unit of the fire control device: the deployment data, the angular change of the initial gun sight angle, or the respective gun sight angle, data, which define the projectile to be fired and its interior ballistics. Data, that define that indirect firing is performed, must also be known to the data processing unit; if needed, such data can be derived from the deployment data. On the basis of the data made available to it, the data processing unit performs its ballistics calculation and from this determines the position of the target marker which here, too, corresponds to the end of an imaginary projectile trajectory and must come as close as possible to the target image.

Numerous advantages are gained by the novel method and with the aid of the novel device, the most important of which will be listed in what follows: an approximately determined initial gun sight angle is set during rough aiming, and in the process the image visualization unit is brought into a position in which the target is already inside the optimal range of the optical device, i.e. in the vicinity of the optical axis of the image visualization unit. By means of this, optimal sight conditions are provided for the rifleman, because undesired effects, such as distortion and light loss are eliminated or minimized. The image visualization unit is moved during sighting and in the course of this the initial gun sight angle is displaced by an angular change; for its ballistics calculation, the data processing unit of the fire control device takes the deployment data, the instantaneous gun sight angle and the interior ballistics of the projectile to be fired into consideration and calculates the position of the target marker from this. Since only a small mass need to be moved during this, sighting can take place effortlessly, rapidly and free of vibrations. Although a larger mass, namely the weapon barrel, must be moved during fine aiming, this movement needs to take place only once and over a short distance.

Rough aiming of the weapon barrel during the first phase of the novel method can take place with direct firing with the aid of an additional sighting unit, such as a rear/front sight unit, or with the aid of the image visualization unit.

The determination of the deployment distance range during the first phase of the novel method mostly takes place approximately during direct firing by an estimation made by eye; however, it can also be performed with the aid of a laser distance measuring unit.

While in the first phase the deployment distance is only approximately determined, it is newly and, if possible, more accurately determined in the second phase. This is achieved either by distance measuring with the aid of a laser distance measuring unit or by the use of external aids, by means of a topographic map or a GPS, if the position of the target is known. The determination of the deployment distance with the aid of a laser distance measuring unit and the direct input of this distance into the data processing unit does simplify the method. However, in connection with weapons for direct firing it is possibly also advantageous to provide the option of determining the deployment distance or the deployment distance range without the aid of a laser distance measuring unit, but with the aid of means external to the weapon, and to make the respective deployment data available to the data processing unit of the fire control device, for the following reasons: in the first place, when not using the laser distance measurement unit, the position of the rifleman cannot be detected by the enemy by making use of the effect of the laser distance measurement, and secondly the weapon does not become useless if the laser distance measuring unit fails. For indirect firing it is necessary anyway to perform the determination of the deployment data without the laser distance measuring unit.

The movement of the weapon barrel and/or the movement of the image visualization unit for setting the gun sight angle can be performed manually, or with the aid of servo devices.

It is advantageous to make further data available to the data processing unit in addition to the already mentioned data, in particular meteorological data, which essentially relate to the exterior ballistics of the projectiles to be fired.

The device for executing the novel method has a device for setting the initial gun sight angle and an image visualization unit. The target image and a target marker can be displayed by the latter, wherein the target image represents the target, and the target marker the end of a projectile trajectory of a projectile to be fired. In the novel device, the image visualization unit is a component of the fire control device. The fire control device furthermore contains an angle measuring unit for measuring the angular change of the initial gun sight angle when sighting the target image, and a data processing unit for performing a ballistic calculation. The ballistic calculation is performed by taking into consideration the deployment data, the angular change of the initial gun sight angle and data defining the projectile to be fired and its interior ballistics. The ballistics calculation must also take into account whether it is intended to fire directly or indirectly. As the result of the ballistics calculation, the data processing unit makes a signal available, which shows the respective position of the target marker.

In direct firing, essentially only the deployment distance is of relevance among the deployment data; it can be visually measured, and the novel device preferably has a distance measuring unit, in particular a laser distance measuring unit for this.

The image visualization unit can be a telescopic sight. A low-light-level amplifier can also be provided. Alternatively, the image visualization unit can comprise an image recording device with an image playback device; for example, a video camera, an infrared camera or a digital camera can be used as image recording devices, and a monitor is general used as the image playback device.

The data processing unit of the fire control device is advantageously coupled with an input unit, with whose help it is possible to input certain data into the data processing unit. These data are deployment data in particular, if they are determined by means external to the weapon, as well as possibly data regarding the projectiles to be fired and their interior ballistics. If only one type of projectiles is always fired, the data regarding the projectiles and their interior ballistics can be definitely stored in the data processing unit. If different types of projectiles are fired, it is necessary to make alternatively selectable data available to the data processing unit, which define the projectile respectively to be fired, and therefore its interior ballistics. The weapon can also be designed in such a way that it recognizes the type of projectile to be fired and makes appropriate data available to the data processing unit internally.

For updating the control device, further data for the ballistics calculation can be made available to the data processing unit with the aid of the input device. The consideration of data, which relate to the exterior ballistics in the widest sense, for example the non-horizontal state of the weapon and meteorological effects, is of predominant interest. Suitable means for detecting the horizontal, or non-horizontal state of the weapon can also be provided, which make appropriate data available to the data processing unit internally in the weapon.

In connection with spin-stabilized projectiles the consideration of possibly existing wind is of interest, since the projectiles used generally have a relatively long flight time, so that possible wind effects also result not only in a lateral thrust, but also in a considerable spin-derived deviation. A suitable wind sensor can be used for detecting the wind, which makes the data it has detected directly available to the data processing unit. However, such a wind sensor provides data which are only valid near the ground and are therefore only usable for ballistics calculations during direct firing. The wind effects can alternatively be measured externally or estimated and input into the data processing unit; this is particularly recommended in connection with indirect firing in which the projectiles reach greater heights. Consideration of the respective wind conditions is particularly indicated because the weapons which are equipped with the novel device are mostly weapons for firing projectiles having low projectile speeds; projectile flying times are correspondingly considerable and therefore the projectiles are subjected to the wind effects for comparatively long periods of time.

Servo devices can be provided to make the displacement of the image visualization unit easier during sighting and/or for aiming the weapon barrel.

The angle measuring unit which is used for detecting the angular change of the initial gun sight angle, or for detecting the respective gun sight angle, can be embodied in such a way that all angles are measured in relation to a reference, for example the horizontal line.

The device by means of which the gun sight angle is changed can be a continuously adjustable-acting adjustment device. But it is also possible to provide an adjusting device operating in steps, for which purpose different positions of rest are provided on the weapon barrel, which can be alternatingly engaged by a detent member of the image visualization unit.

The device for executing the method of the invention is preferably embodied as a module and arranged in a housing. The housing can be fastened on a weapon at a later time. This makes retrofitting existing weapons possible, as well as the use of a uniform module with different weapons, and furthermore makes the replacement of a defective device easier. Such a housing does not necessarily have to contain all components of the novel device, the angle measuring unit in particular can be arranged somewhere else and can be connected with the data processing unit with the aid of connecting lines.

Weapons with which the device in accordance with the invention can be particularly advantageously employed are, inter alia, machine guns, grenade launchers, mortars and light infantry cannons, i.e. as a whole autonomously operating weapons which are used to attack stationary or slowly moving targets. The advantages of the novel method, or of the novel device, come to light in particular in case programmable projectiles of the ABM type are fired. Therefore the weapons on which the novel device is arranged advantageously have a programming unit for programming, or timing the fuse of the projectiles.

The invention will be extensively described in what follows by means of exemplary embodiments and by making reference to the drawings.

DETAILED DESCRIPTION OF THE PREFERRED EMBODIMENTS

In what follows, the same reference symbols will be used for like elements in all drawing figures, even if these elements differ in detail. The drawings are not to scale. Aiming is understood in what follows to be the movement of the weapon barrel, respectively together with the image visualization unit; sighting is understood to be the movement of the image visualization unit in respect to the weapon barrel.

Figure 1A:
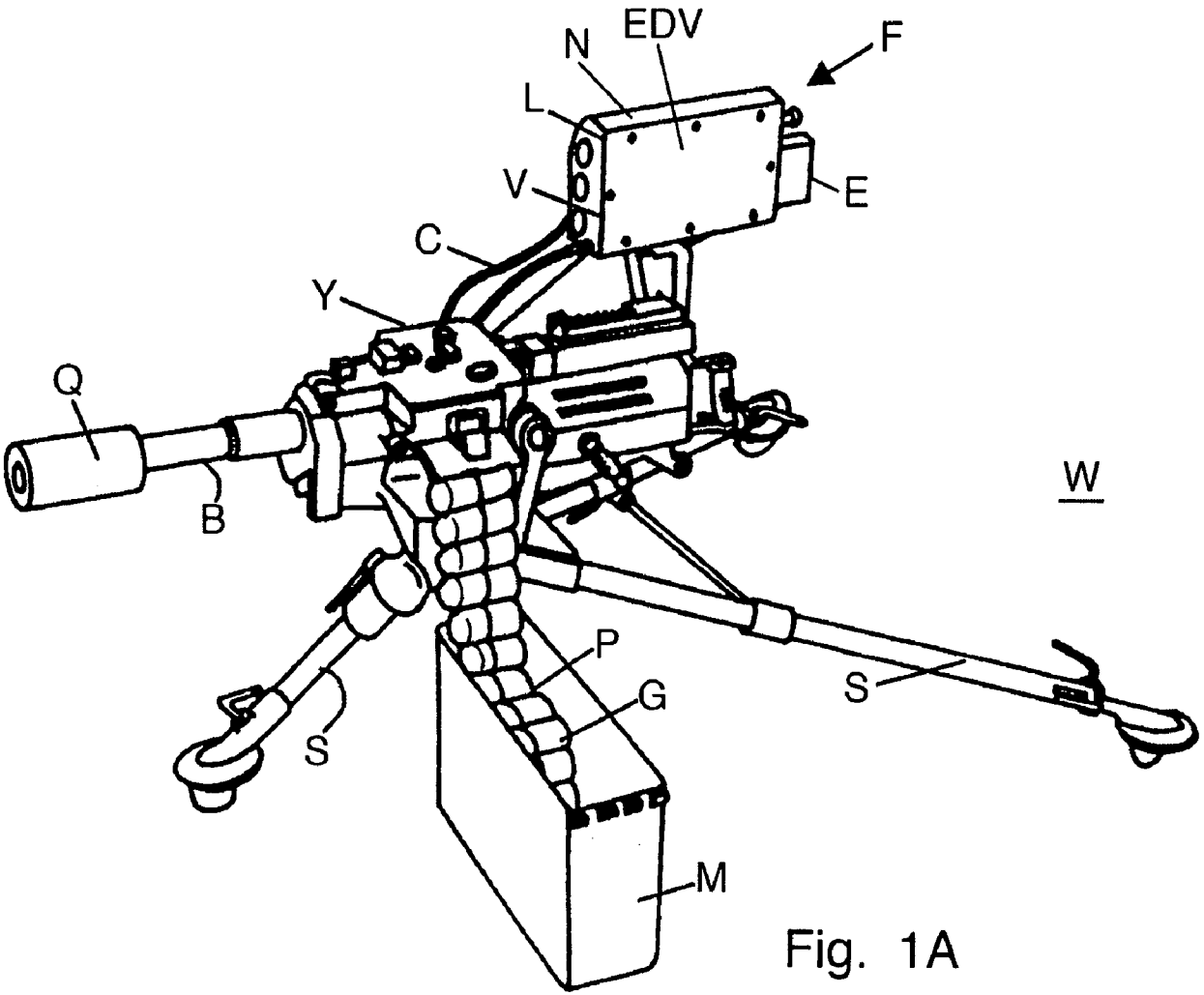
FIG. 1A is a graphic representation of a weapon with the device of the invention.

The weapon W represented in FIG. 1A has a weapon barrel B with a weapon barrel axis b, which is often also called the bore axis, and a support structure in the form of a tripod mount S. The weapon W has a programming unit Q, by means of which projectiles P to be fired can be programmed, or their fuses timed. In the instant case the programming unit Q is arranged at the front end of the weapon barrel B, however, it could also be positioned elsewhere. The weapon barrel B is fastened on the tripod mount S in such a way that its elevation and azimuth can be changed in respect to the latter. In addition, FIG. 1 shows a magazine M and an ammunition belt G with the projectiles on their way from the magazine M to the weapon W. The device optionally includes a wind sensor, not represented.

The device in accordance with the invention contains an image visualization unit V, which can also be considered to be a part of the fire control device F. Further components of the fire control device F are an angle measuring unit Y, a laser distance measuring unit L and a data processing unit EDV with an input unit E for the manual input of data, in particular of deployment data D[E] and of data D[A] which define the exterior ballistics of the projectiles P to be fired, as well as, if desired, of data D[P] and D[I], which define the projectiles P, or their interior ballistics. The data processing unit EDV is designed for performing ballistics calculations on the basis of the totality of the data made available to it.

The image visualization unit V is fastened on the weapon barrel B and can be continuously adjusted in relation to the weapon barrel B. The optical axis of the image visualization unit V forms a sighting line v, along which the rifleman can sight the target Z when firing directly. A displacement of the image visualization unit V in relation to the weapon barrel B means that the angle formed by the weapon barrel axis b and the sighting line v, which is called the gun sight angle ψ, is changed. The gun sight angle ψ is that angle by which the weapon barrel B must be elevated over the tangent of a theoretical projectile path, which ignores the effects of gravity on the projectiles P to be fired, which will be explained in greater detail in reference to FIG. 2A and FIG. 3A.

The image visualization unit V can also be used without the remaining components of the fire control device F, it can in particular be used for rough aiming of the weapon barrel B. An additional simple sighting unit of the rear/front sight type can also be provided for this.

Figure 1B:
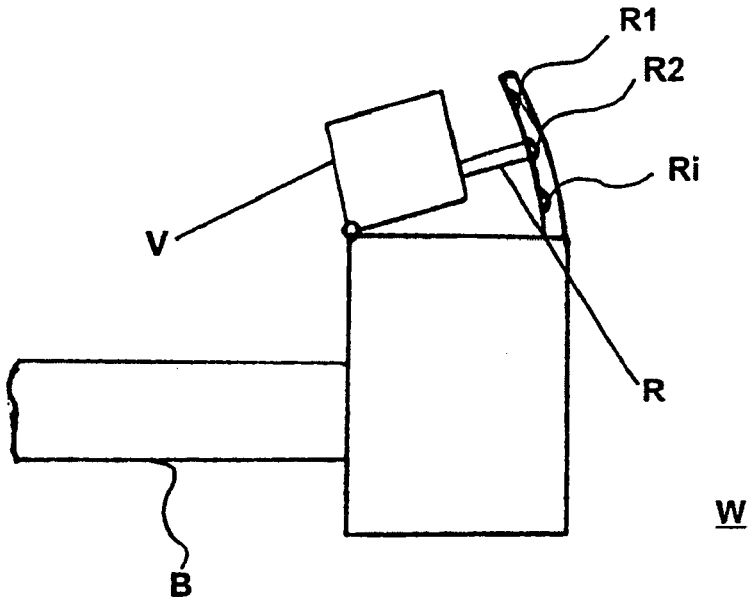
FIG. 1B shows a detail of a further device of the invention in a greatly simplified manner.

In accordance with FIG. 1B, the image visualization unit V can also be arranged in such a way that it is not continuously adjustable in relation to the weapon barrel B, but in steps, so that it can only be brought into predetermined, instead of arbitrary, positions of rest in relation to the weapon barrel B. The weapon barrel B has a device for this purpose, which defines several positions of rest R1 to Ri. The image visualization unit V has a detent member R, which can be alternatingly brought into one of the positions of rest R1 to Ri.

Basically the fire control device F is designed to be modular, and it is arranged in a housing N, so that it can be removed as a unit from the weapon W. Some components of the fire control device F, in particular the angle measuring unit Y, are arranged outside the housing N in the instant exemplary embodiment and are connected by means of conductor lines C with the data processing unit EDV.

Figure 2B:
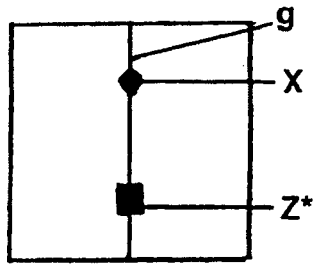
FIG. 2B shows the image displayed during direct firing by the image visualization unit during sighting.
Figure 2A:
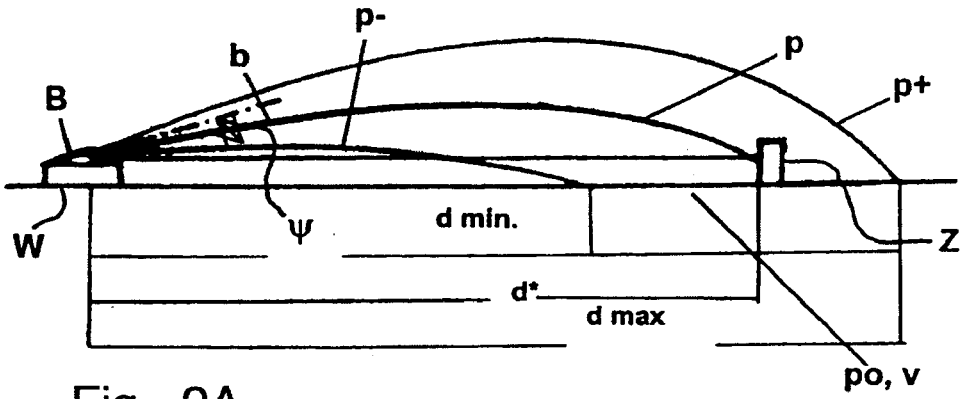
FIG. 2A is a representation for explaining the conditions in connection with direct firing.

FIG. 2A shows the weapon W in a deployment for attacking the visible target Z, or for direct firing. In direct firing, the deployment distance d* by which the target Z is distant from the weapon W, or a deployment distance range d with a lower limit $d^*_{min}$ and an upper limit $d^*_{max}$, in which the target is assumed to be, is estimated from the deployment data D[E], and an initial gun sight angle $\psi_o$ is set. Other deployment data D[E] are generally not taken into consideration. The gun sight angle ψ is a function of the deployment distance d* for each respective defined type of projectiles P. The gun sight angle ψ equals the angle between the weapon barrel axis b and a sighting line v, which connects the weapon W with the target Z. The gun sight angle ψ can also be considered as the angle, on the one hand between the tangents on a projectile trajectory p of an actual projectile, and a projectile trajectory $p_o$ of a projectile $P_o$ with an unlimited projectile speed, each time at the mouth of the weapon barrel B. In FIG. 2B the projectile trajectory p is the trajectory of a projectile P which hits the target Z; p+ and p− define trajectories of projectiles which do not hit the target, because the shot was too long or too short.

Actual sighting takes place in the second phase. FIG. 2B shows the image which the image visualization unit shows the rifleman. Sighting is performed by sighting on a target image Z* by means of the image visualization unit V. The target image Z* is the displayed image of the target Z. In the course of sighting, the initially set gun sight angle $\psi_o$ changes by the respective amount of angular change Δψ. The angular change Δψ, or the respective gun sight angle ψ, is measured with the aid of the angle measuring unit Y, and the result of the measurement is made available to the data processing unit EDV. The deployment distance d* is exactly measured with the aid of the laser distance measuring unit L, and the result of this measurement is also made available to the data processing unit EDV. Taking into account the deployment distance d*, the gun sight angle ψ and the data D[I] defined by the interior ballistics of the projectiles P to be fired, the data processing unit EDV now performs a ballistics calculation, by means of which imaginary projectile trajectories p are continuously determined. The data D[I], which define the projectile P, or its interior ballistics, are stored, wherein it is possible that the data D[I] must be selected for one of several types of projectiles by means of the input unit E, or the data D[I] are entered by means of the input unit E. In each case the end of the projectile trajectory p is displayed as the target marker X. Sighting is continued until the target marker X and the target image Z* coincide as much as possible, wherein the projectile trajectory p ends near or directly on the target Z. As already mentioned, p+ and p− identify further projectile trajectories over which the projectiles pass and which do not hit the target Z.

FIG. 2B shows the target marker X and the target image Z* of a vertical line g. This is the case when the weapon W is placed horizontally, so that a change of elevation does not result in a change in the azimuth.

Fine aiming of the weapon barrel B then takes place in the third phase with the gun sight angle ψ which had been set at the end of the second phase.

Figure 3B:
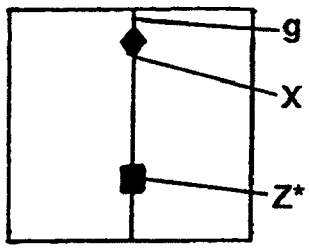
FIG. 3B shows the image displayed during indirect firing by the image visualization unit during sighting.
Figure 3A:
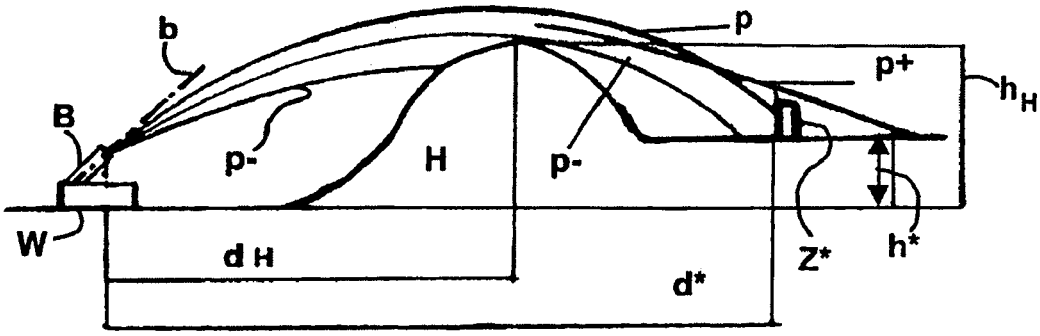
FIG. 3A is a representation for explaining the conditions in connection with indirect firing.

FIG. 3A shows the weapon W in a deployment for attacking the target Z located behind an obstacle H and not visible from the weapon W. Here, attacking the target Z is performed by indirect firing. The deployment data D[E] include the deployment distance d*, the deployment height h*, the relevant obstacle distance dH and the relevant obstacle height $h_H$. These deployment data D[E] are determined in the first phase of the novel method with the aid of means external to the weapon, since they can neither be measured nor estimated. A suitable topographic map can be used as the means external to the weapon. The initial gun sight angle ψ is determined on the basis of the deployment data D[E] and is set. Now a target image Z*, imaginary in this case, whose position is determined by the deployment data D[E], is displayed by the image visualization unit V. During indirect firing the remaining portion of the method essentially occurs in the same way as described above in connection with direct firing, wherein FIG. 3B shows the image displayed by the image visualization unit to the rifleman: the target image Z* is sighted, in the course of which the initial gun sight angle $\psi_o$ is changed by the amount of the angular change Δψ. The angle measuring unit Y determines the angular change Δψ, or the respective gun sight angle ψ. The following data are made available to the data processing unit EDV: the deployment data D[E], the angular change Δψ, or the respective gun sight angle ψ, data D[I], which define the interior ballistics of the projectiles P to be fired, and preferably data D[A], which determine the exterior ballistics of the projectile P to be fired. The data processing unit EDV continuously performs its ballistics calculations and make a signal available, which respectively corresponds to the end of an imaginary projectile trajectory p which would result with the respective gun sight angle ψ and by means of which the respective position of the displayable target marker X is determined. The target image Z* and the target marker X are made to coincide as much as possible. The projectile trajectory p in FIG. 3B is the trajectory of a projectile P which hits the target Z; p+ and p− identify projectile trajectories of projectiles which do not hit the target Z.

If the target image Z* and the target marker X are completely congruent, the projectile P, which is now actually fired from the weapon W, will hit the target Z with the greatest degree of probability provided, of course, that the target Z has not moved away in the meantime and no unexpected meteorological effects have made themselves felt.

Figure 4:
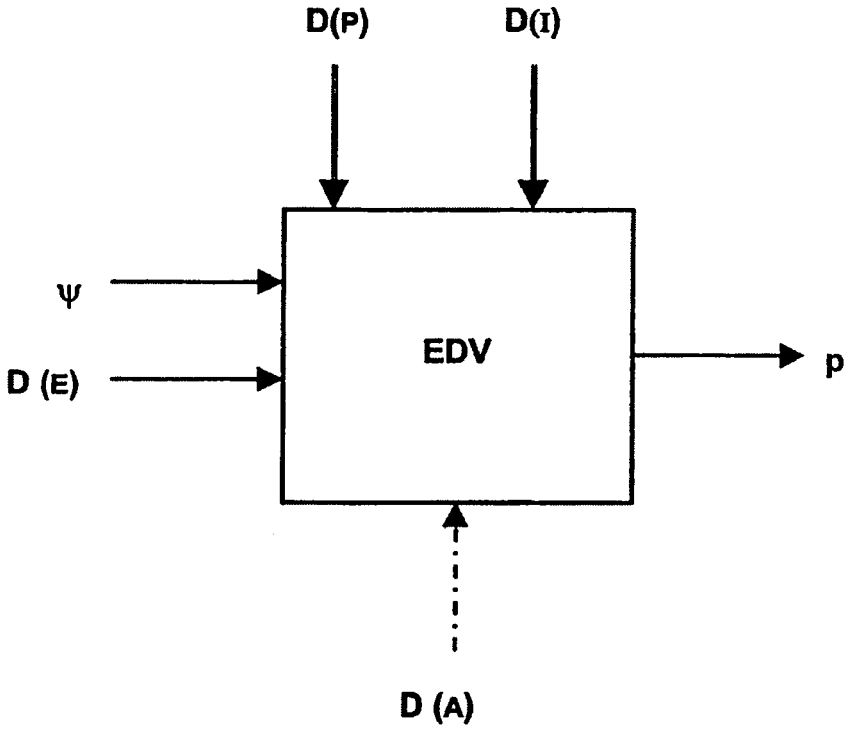
FIG. 4 is a schematic view of a data processing unit with the data made available for the ballistics calculation and with the result of the ballistics calculation.

FIG. 4 schematically shows the data processing unit EDV, along with the data made available for the ballistics calculations and with the result of the ballistics calculations performed in the second phase of the novel method. The data which can possibly be definitely input and stored, are indicated by double lines, namely the data D[P] relating to the projectile P and the data D[I] relating to the interior ballistics. Those data which must absolutely be known for executing the novel method are shown by normal lines, namely the deployment data D[E] and the respective gun sight angle ψ. Those data which can be optionally input are shown in dashed lines, in particular the data D[A] defining the exterior ballistics.

It should also be mentioned that in actual use the opportunity for obtaining a hit is not as would be assumed on the basis of the representation by the image visualization unit at the time the shot was fired. For one, hits are fewer than expected, inter alia because the fine aiming did not take place optimally and/or the exterior ballistics had not been sufficiently taken into consideration. On the other hand, more hits are obtained than expected, because the interior ballistics, as well as the exterior ballistics, of the projectiles are slightly different from one projectile to the next, so that when a salvo is fired, a certain dispersion practically always occurs.

As already mentioned at the outset, the novel method and the novel device are mainly designed for use with autonomously operating weapons, which are operated by the rifleman alone. Among these are in particular infantry weapons such as machine guns, grenade launchers, mortars and infantry cannon.

It is possible to achieve particularly advantageous synergies if ABM is fired using the novel method, or the novel device.

Finally it should also be mentioned that the method steps can be performed, at least in part, in sequences which are different from the sequence in the claims.

What is claimed is:

1. A method for aiming a weapon on a target, the weapon
having a weapon barrel with a weapon barrel axis,
being adapted to launch a projectile along a trajectory,
having a fire control device with a data processing unit, and
having a programming unit for programming the projectile, wherein
a target image representing the target and a target marker representing the end of a projectile trajectory are displayed with the aid of an image visualization unit having a sighting line,
the method comprising the following steps:
in a first phase:
the weapon is fastened on a mount, and
rough aiming of the weapon barrel is performed, wherein
deployment data are determined, which define the position of the target in relation to the weapon, and
an initial gun sight angle corresponding to the deployment data is set between the weapon barrel axis and the sighting line of the image visualization unit;
in a second phase, with the weapon barrel stationary:
sighting of the target is performed, the target being sighted by means of the visualization unit, wherein the initial gun sight angle is changed by an angular change,
the angular change is measured,
data related to the angular change are made available to the data processing unit by means of conductor lines, and
further data including the deployment data and including data relating to the projectile to be fired and the projectile interior ballistics are made available to the data processing unit in order to enable the data processing unit to continuously perform a ballistics calculation and to make a signal available describing the position of the target marker to be displayed,
the target marker is displayed, and
the target image and the target marker are brought into coincidence as closely as possible, and
in a third phase:
fine aiming of the weapon barrel is performed, and
the projectile is programmed by means of the programming unit.

2. The method in accordance with claim 1, wherein
the determination of the deployment data takes place with the aid of means external to the weapon including at least one of a topographic map and a GPS.

3. The method in accordance with claim 1, wherein
the displayed target image is an image of the visible target, which can be attacked by direct firing.

4. The method in accordance with claim 1, wherein
a deployment distance is determined as the deployment data.

5. The method in accordance with claim 4, wherein
the determination of the deployment distance takes place by approximately determining a distance range within which the deployment distance is assumed to lie.

6. The method in accordance with claim 4, wherein
the determination of the deployment distance takes place by means of a distance measuring unit internal to the weapon including a laser distance measuring unit.

7. The method in accordance with claim 1, wherein
the setting of the gun sight angle is performed manually.

8. The method in accordance with claim 1, wherein
the data made available to the data processing unit and which relate to the projectile include data relating to the exterior ballistics of the projectile.

9. The method in accordance with claim 8, wherein
the data relating to the exterior ballistics include meteorological data.

10. The method in accordance with claim 1, wherein
data or a signal are made available to the data processing unit, which indicate whether there will be direct or indirect firing.

11. The method in accordance with claim 1, wherein
the setting of the gun sight angle takes place in steps into defined positions of rest.

* * * * *

UNITED STATES PATENT AND TRADEMARK OFFICE

CERTIFICATE OF CORRECTION

PATENT NO. : 7,089,845 B2
APPLICATION NO. : 10/267268
DATED : August 15, 2006
INVENTOR(S) : Andreas Friedli et al.

It is certified that error appears in the above-identified patent and that said Letters Patent is hereby corrected as shown below:

On the title page item (75), delete the name "Aw Cheng Hok" and replace it with --Cheng A.W. Hok--.

On the title page item (75), delete the name "Ng Say Him" and replace it with --Say N.G. Him--.

On the title page item (57), Abstract, line three, after the word "unit", delete the letter "M" and replace it with --[V]--.

Signed and Sealed this

Twenty-eighth Day of November, 2006

JON W. DUDAS
*Director of the United States Patent and Trademark Office*